US005870060A

United States Patent [19]

Chen et al.

[11] Patent Number: 5,870,060

[45] Date of Patent: Feb. 9, 1999

[54] FEEDER LINK ANTENNA

[75] Inventors: Chun-Hong Harry Chen, Torrance; Young Suck Kwon, Rancho Palos Verdes, both of Calif.

[73] Assignee: TRW Inc., Redondo Beach, Calif.

[21] Appl. No.: 641,602

[22] Filed: May 1, 1996

[51] Int. Cl.[6] ..... H01Q 3/12

[52] U.S. Cl. ..... 343/761; 343/781 R; 343/786; 343/DIG. 2

[58] Field of Search ..... 343/781 R, 786, 343/756, 761, 839, 765, DIG. 2; 333/126, 137; H01Q 3/00, 3/12

[56] References Cited

U.S. PATENT DOCUMENTS

| | | | |
|---|---|---|---|
| 3,560,976 | 2/1971 | Foldes | 343/786 |
| 3,696,434 | 10/1972 | Sciambi | 343/786 |
| 3,968,497 | 7/1976 | Bui Hai | 343/786 |
| 4,199,764 | 4/1980 | Williams et al. | 343/786 |
| 4,228,410 | 10/1980 | Goudey et al. | 333/122 |
| 4,258,366 | 3/1981 | Green | 343/786 |
| 4,420,756 | 12/1983 | Hamada et al. | 343/786 |
| 4,586,051 | 4/1986 | Saitto et al. | 343/DIG. 2 |
| 4,847,574 | 7/1989 | Gauthier et al. | 33/21 A |
| 5,003,321 | 3/1991 | Smith et al. | 343/786 |
| 5,258,768 | 11/1993 | Smith | 343/786 |

FOREIGN PATENT DOCUMENTS

| | | |
|---|---|---|
| 2651071 | 4/1989 | France . |
| 3629315 | 3/1988 | Germany . |
| 2253520 | 9/1992 | United Kingdom . |

OTHER PUBLICATIONS

Shiau et al, "NASA Acts Automatic Antenna Feed System" pp. 83–86, 1986 IEEE AP–S Symposium Digest, Jun. 1986.

Patent Abstracts of Japan, JP 03236614, Oct. 22, 1991, E1156, vol. 16, No. 22, Jan. 20, 1992.

*Primary Examiner*—Michael C. Wimer

*Attorney, Agent, or Firm*—Michael S. Yatsko; Ronald M. Goldman

[57] ABSTRACT

A steerable feeder link antenna is formed of a steerable reflector and a stationary feed horn assembly. A novel feed horn assembly allows dual mode transmit and receive functions for circularly polarized microwaves. The feed horn assembly includes a four arm turnstile junction coupled to a feed horn through the feed horn's side wall to couple transmit frequencies and an axially coupled transmission line for the receive frequencies. Each turnstile junction arm incorporates chokes for the receive frequencies. The transmission line's cut off frequency is above the transmit frequency to prevent transmit signals from interfering with receive signal receivers.

3 Claims, 3 Drawing Sheets

FEEDER LINK ANTENNA

FIELD OF THE INVENTION

The present invention relates to microwave feeder link antennas for satellite communications systems and, more particularly, to an architecture for feeder link antennas for dual band operation and to the feed horn assembly used therewith.

BACKGROUND

Global mobile communications systems, such as the proposed Odyssey™ system described in patent U.S. Pat. No. 5,433,726, require both mobile link antennas and feeder link antennas for the spacecraft. The mobile link antennas establish the communication link with mobile users and the feeder link antennas relay those communications to earth stations where they are connected to the world-wide public switched telephone network.

The plurality of the antennas carried by the spacecraft warrants stringent weight control for the antennas. The large number of antennas required in the system overall, as example a total of forty five antennas in Odyssey, the multiple of three antennas per spacecraft and fifteen spacecrafts, also requires low unit production cost. Such cost and weight constraints are in addition to the antenna's demonstrating acceptable levels of RF performance. The link antenna may be required to simultaneously or alternately transmit and receive circularly polarized (CP) signals at two different frequencies, one frequency typically being separated from the other by at least ten per cent of that one frequency. It should also do so with high gain and low sidelobe levels. Such link antenna may also be used to transmit two separate frequencies or to receive two separate frequencies. Advantageously, the antenna described herein achieves these requirements.

In prior satellite communications systems, the architecture has been to attach the respective antenna, comprising a parabolically curved reflector and feed horn, to the electronics box or container that houses the electronics. The entire assembly, antenna and electronics container, is then placed on gimbals that position or steer the antenna to the earth station.

Two factors contribute to the heavy weight of such a system. First, to maneuver a large mass and therefore the momentum, a heavy duty gimbal system is necessary. As example, the electronics box alone weighs more than 18 Kg each. Second, to secure the heavy electronics and antenna assembly in place during the launching vibration, requires the use of a heavy caging structure.

An object of the present invention, therefore, is to reduce the weight of a feeder link antenna system, particularly, to reduce the weight of the ancillary equipment required for antenna system transport in space craft, such as the caging structure.

Further the feed horn assembly used in those prior systems is relatively simple in appearance. It includes a horn and a waveguide transmission line containing, in serial order, a rexolite rod, a transmit polarizer, a transmit orthomode transducer, a receive polarizer and a receive mode launcher. In practice it is found that such known structure required adherence to strict manufacturing tolerances. Following manufacture, the prior feed system required adjustment and labor intensive tuning to ensure its proper electrical performance. Since any adjustment to one component in that feed system influenced the electronic characteristices of the other components in that feed by means of electromagnetic interaction, tuning often involved iterative cycles of tuning, testing, and inspection.

Another object of the invention, thus, is to provide a dual band feed horn assembly that has less restrictive dimensional tolerance requirements than heretofore, avoids time consuming and laborious testing and adjustment procedures, is less costly to manufacture, and is less temperature sensitive than prior dual mode feed horn assemblies.

SUMMARY OF THE INVENTION

In accordance with the foregoing objects, an antenna assembly includes a feed horn assembly and a curved reflector in which the feed horn assembly is mounted in fixed position and the reflector is gimbled for steering over a sector of a hemisphere. With the feed horn directed at the reflector, the reflector, like a mirror, reflects microwave energy to and from the feed horn assembly. Preferably the reflector contains a long focal length. Sufficient focal length provides adequate microwave performance in the communications system, even though the feed horn is not positioned at the reflector's focal point. Both the gimbaled reflector and the feed horn are mounted at spaced positions along a bracket that serves to fix the spatial relationship of the two components. The open end of the feed horn is located more proximate the reflector's concave surface than the reflector's focal point, irrespective of the reflector's orientation about a hemisphere of possible positions. The bracket is mounted to a platform, which in turn is intended for mounting to a spacecraft.

In accordance with a second aspect of the invention, a novel dual band feed horn assembly is used to alternately transmit circularly polarized microwave frequency signals of one frequency and receive circularly polarized microwave frequency signals of another higher frequency. The microwave dual band feed assembly includes a feed horn, a first waveguide connected to the feed horn for propagating therefrom microwaves of the receive frequency for transmission to an external microwave receiver, and a turnstile junction for coupling microwaves of the transmit frequency to the feed horn.

The turnstile junction means includes an input for receiving microwave energy of the first frequency from a microwave transmitter and four outputs to output microwaves of that frequency at four spaced positions and in relative electrical phase of zero, ninety, one hundred and eighty and two hundred and seventy degrees, thereby producing circularly polarized microwaves at that frequency. Those outputs are connected to the feed horn at equally circumferentially spaced positions at a predetermined position along the feed horn axis to excite a maximal circularly polarized wave.

The feed horn opening to the transmission line is sized to have a cut off frequency greater than transmit frequency f1 to prevent any transmitted signals from being diverted through the transmission line to the receiver. RF chokes are included in each arm of the turnstile junction to prevent microwaves of the receive frequency, received in and propagating within the feed horn to the transmission line, from diversion into the turnstile junction.

It is found that the foregoing feed assembly does not require extensive tuning or adjustment in contrast to prior structures, thereby permitting more efficient and lower cost manufacture. As the foregoing feed assembly is comparible in weight with the prior feed assembly, even a small increased weight does not offset the considerable weight savings achieved in the overall antenna combination.

Accordingly, both lower manufacturing cost and weight savings are achieved in the antenna and feed system combination.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
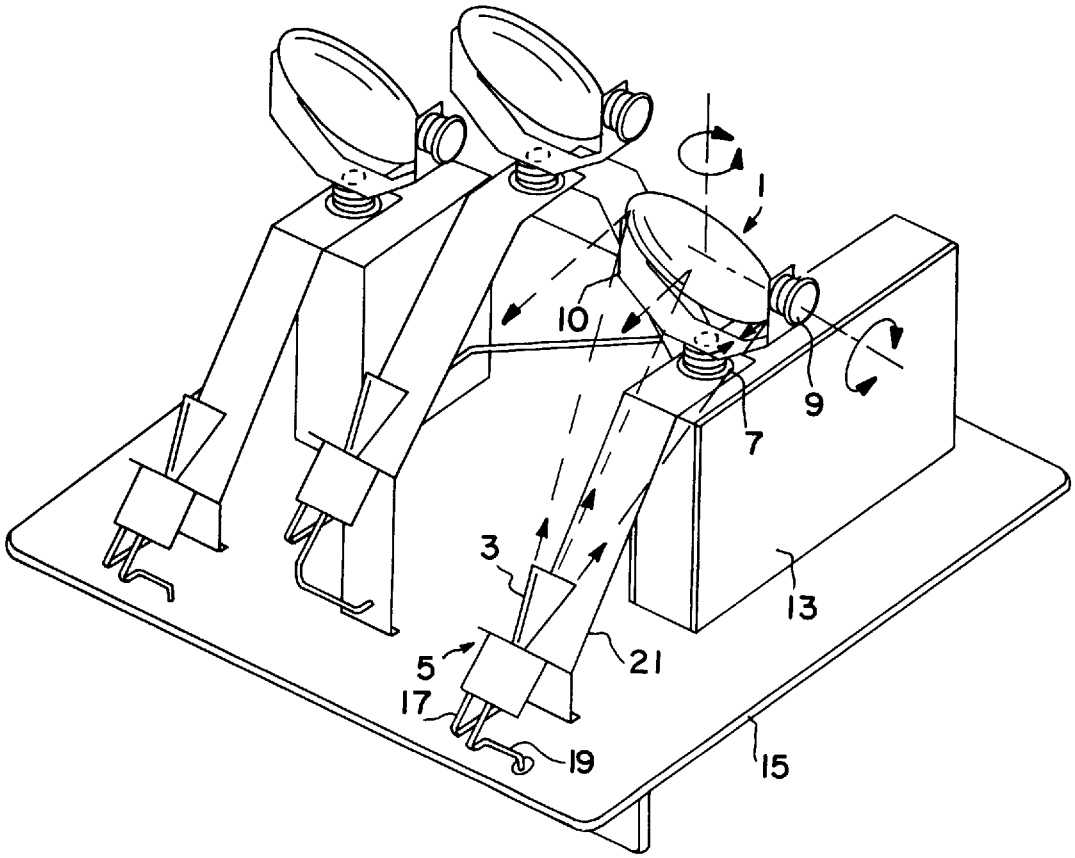
FIG. 1 is a perspective view of a steerable feeder link antenna constructed according to the invention.

Reference is made to FIG. 1 which illustrates an embodiment of a feeder antenna constructed according to the invention. The antenna includes a reflector 1 and a feed assembly 5. The feed assembly contains a feed horn 3. Reflector 1 may comprise a solid piece of metal that is concavely shaped into one of the conventional curves used for reflector type microwave antennas, such as parabolic, or may be so formed of wire mesh or of composite graphite material, all of which are known structures. Gimbals 7 and 9 and support bracket 11 serve to support reflector 1 in position atop the metal container 13, that serves to house the transmitting and receiving electronics, not illustrated. Container 13 in turn is mounted in fixed position on platform 15. The platform is intended to be placed on or in, as appropriate, a communications satellite.

Gimbal 9 is a conventional electrical positioning and sensor device, attached to bracket 11, that angularly swivels the reflector about support bracket 11, the horizontal axis illustrated; and gimbal 7, a like device, is attached to metal container 13 and angularly swivels bracket 11 about a mutually orthogonal axis, the vertical axis illustrated. The gimbals thereby steer the reflector over a sector of a hemisphere; that is, position the reflector's attitude and elevation. Since the electronic controls and electrical leads and accompany electrical circuits for supplying driving current to the gimbals and sending position information therefrom are known and not necessary to an understanding of the invention, they are not illustrated or further described. As those skilled in the art recognize, other gimbal arrangements may be substituted in alternate embodiments to steer the reflector, such as a bi-axial gimbal attached to the back side of the reflector.

Feed horn 3 forms part of a feed assembly, designated 5 in the figure. That assembly houses RF coupling components, described hereafter in greater detail, and is electronically coupled by waveguides 17 and 19 or the like to the electronics box 13 via a routing on the underside of platform 15. The feed horn is supported by a downwardly sloping angular formed bracket 21 in fixed position. At one end, bracket 21 is attached to the surface of platform 15; at the other end, the bracket is held clamped between the underside of gimbal 7 and the upper surface of container 13. Bracket 21 thereby serves to maintain the relative horizontal distance between the feed horn 3 and gimbal 7 mounting position fixed and the axial distance along the feed horn axis and the reflector 1 fixed. Alternately, feed assembly 5 can be a separate structure attached to platform 15. However, the latter approach is less preferred, since it requires the qualification test of the antenna in situs, whereas the former technique allows such qualification tests to be conducted individually prior to installation on the platform. As illustrated, the satellite in practice typically supports two additional like steerable antennas.

Only reflector 1 is gimbaled while all electronics and the feed horn remain stationary in position. Through the gimbal controls, the antenna beam direction is changed in attitude and elevation just like a mirror would deflect an incident light beam. Since the reflector weight amounts to only a fraction of the total feeder link assembly weight, small size gimbals and light weight caging are sufficient to steer the beam and survive the vibration during satellite launch. That alone results in considerable weight savings.

As those skilled in the art appreciate, the described gimbaled reflector in operation incurs higher scan loss, which occurs due to the fact that the feed horn is or becomes displaced from the focal point of the reflector. This loss is mininimized, however, by judiciously designing the reflector geometry and the feed horn so that even at the worst scan angle the antenna gain remains sufficiently high to close the communication link with some performance margin remaining in reserve. Specifically, this involves the use of longer focal length and oversized reflector than required by conventional systems. The preferred focal length is chosen so that the relationship of F/D is larger than 0.7, where F is the focal length and D is the reflector aperature projection diameter. And as illustrated in the figure, the flared end of the feed horn is located closer to the reflector's concavely shaped surface than that concave surface's focal point, irrespective of the orientation of said curved surface. That is, the distance to the end of the feed horn is less than the focal length of the reflector's curved surface.

Figure 2:
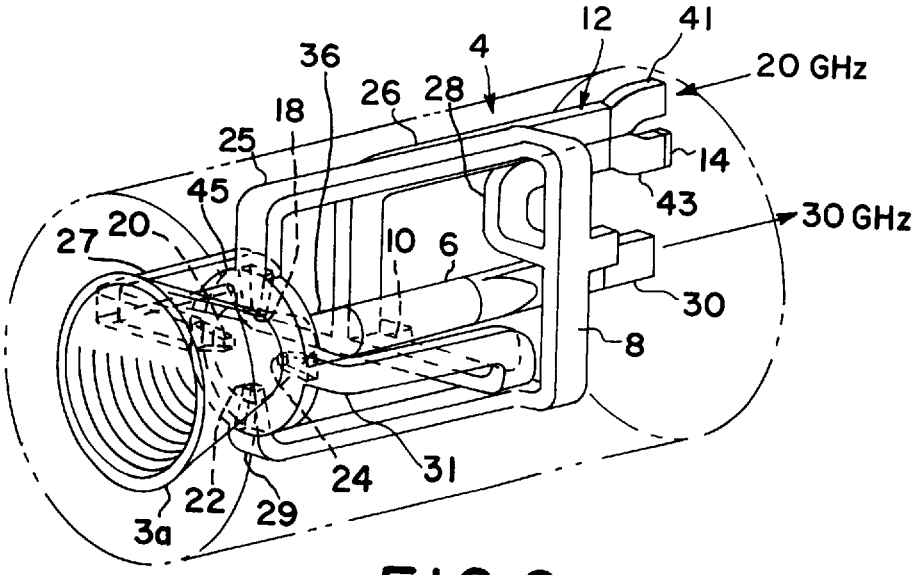
FIG. 2 is an illustration of a novel feed horn assembly, constructed in accordance with another aspect of the invention, that is used in the antenna of FIG. 1.
Figure 3:
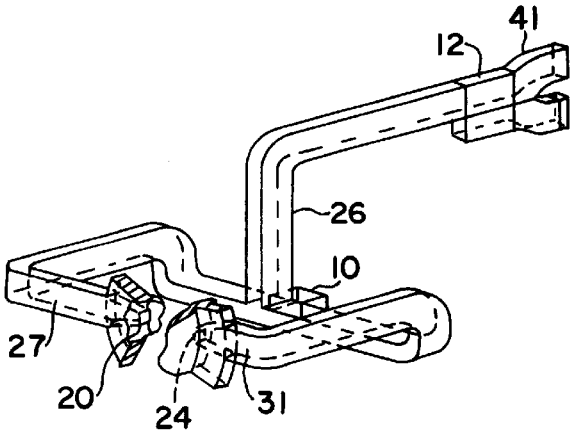
FIG. 3 is a perspective view of one portion of the turnstile junction appearing in FIG. 2.
Figure 4:
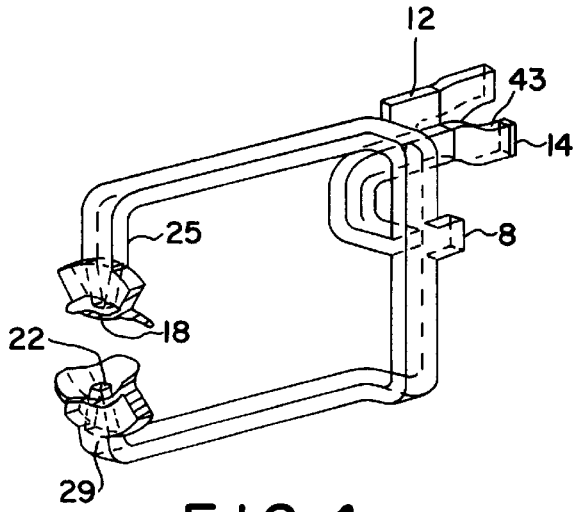
FIG. 4 is a perspective view of another portion of the turnstile junction appearing in FIG. 2.
Figure 7:
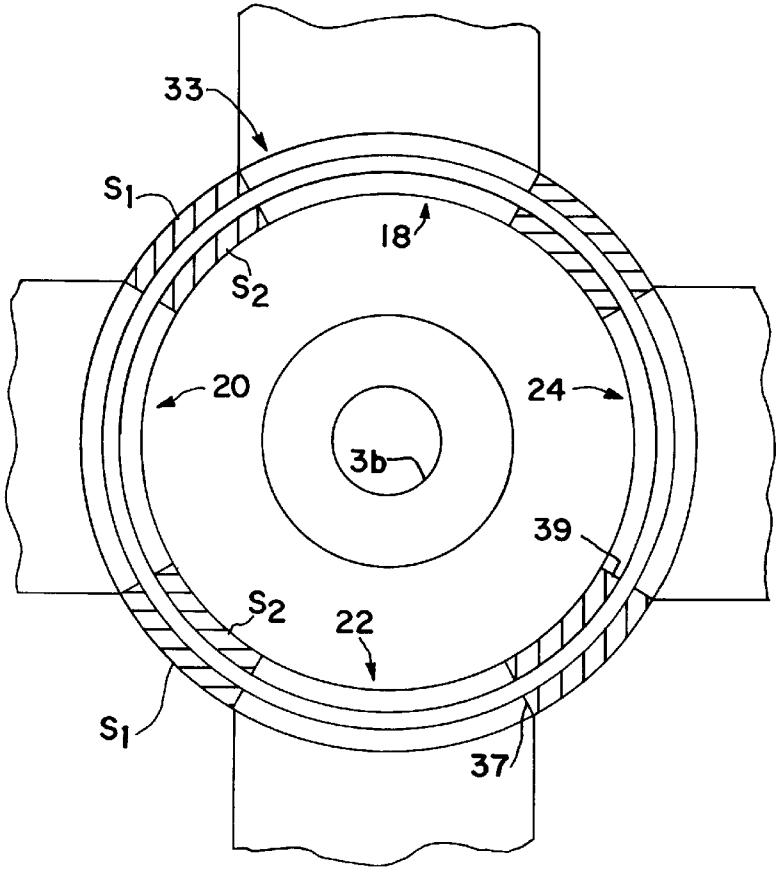
FIG. 7 is a partial section view of FIG. 6 taken along the lines 7—7 that better illustrates the microwave choke construction and the turnstile junctions outlet end.
Figure 6:
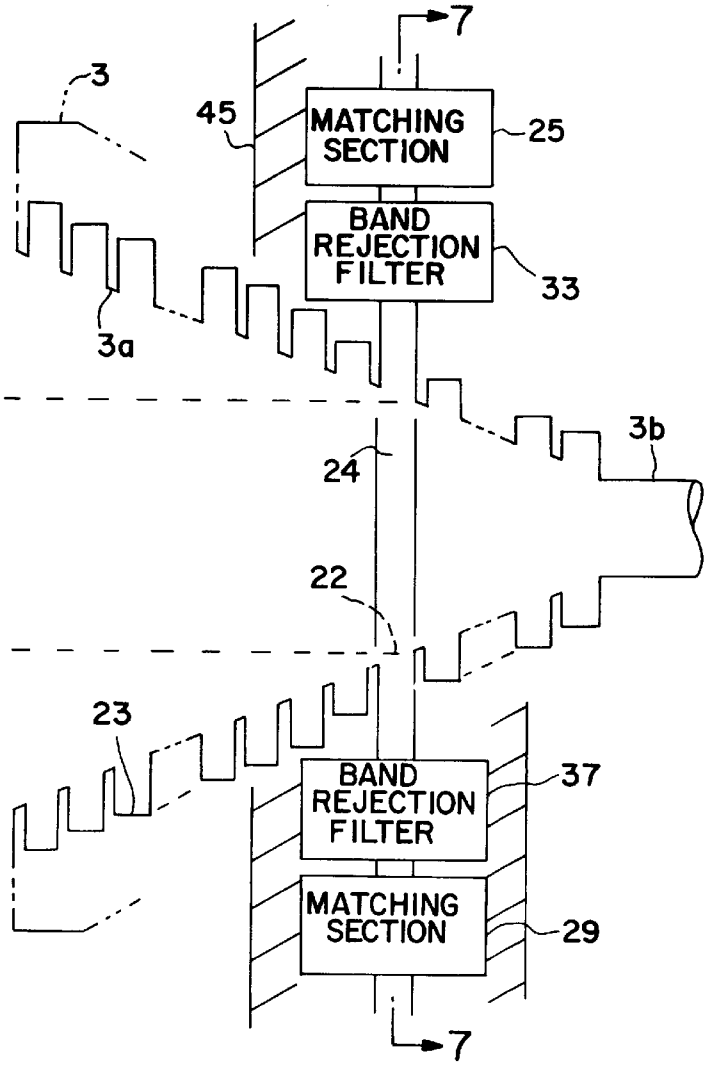
FIG. 6 is a pictorial partial section view of the corrugated horn used in FIG. 2 drawn to larger scale.

The novel feed horn and feed horn assembly for the dual band system is illustrated in greater detail in the perspective of FIG. 2, to which reference is made, and to the side view of that embodiment presented in FIG. 6 and the front view thereof in FIG. 7. The assembly is principally comprised of the corrugated horn 3, a turnstile junction (TJ) 4, a polarizer 6 and a circular to rectangular waveguide transition 2.

The corrugated feed horn 3 is a known microwave antenna device that comprises the geometry of a sector of a right cone 3*a* leaving circular openings at each end, the larger diameter opening shown to the left in the figure and a smaller diameter opening to the right, that is combined with a cylindrical tube or throat 3*b*, defining a cylindrical passage that forms a short extension to the cone. The inner cone walls are corrugated in accordance with standard practice for microwave horns. This known horn structure is modified to accomodate the turnstile junction as hereafter described.

A turnstile junction is a known microwave device containing four waveguides oriented perpendicular to the circumference of a main waveguide manifold. Those four waveguides are spaced ninety degrees apart about that circumference. Band pass filters or band rejection filters are used at the junctions between the waveguides and the manifold to separate the microwave signals that flow straight through the manifold and those that are diverted into the perpendicular waveguides. An example of such a device is found in patent U.S. Pat. No. 4,420,756. The four arms are connected by two magic-T's and one 90 degree hybrid.

Figure 5:
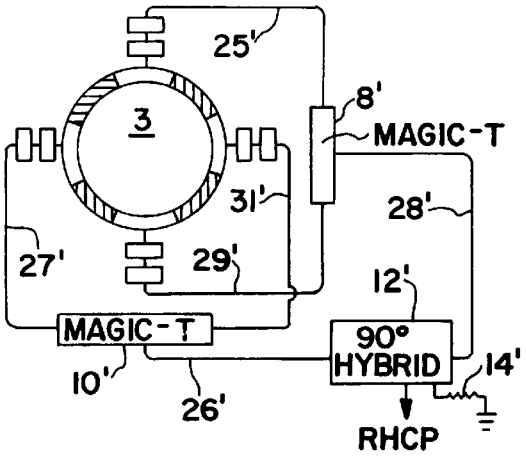
FIG. 5 illustrates the turnstile junction in the feed horn assembly of FIG. 2 in schematic form.

The Turnstile Junction in this embodiment is preferably formed of one 90 degree-Hybrid 12, two magic-T's 8 and 10, four matching sections 25, 27, 29 and 31, several interconnecting waveguides 26, 28 and 30, and four chokes 33, 35, 37 and 39, the latter of which are visible in FIG. 7. One of the two inlet ports to hybrid 12 is terminated by termination 14. This arrangement is also schematically illustrated in FIG. 5.

Further, the turnstile junction contains two inlet arms 41 and 43, the latter of which is terminated by a load 14, when only a single circularly polarized wave is needed. The turnstile junction's four outlet ports, 18, 20, 22 and 24, are formed in a ring member 45 or collar, discussed at greater length in connection with FIG. 7, and are equally angularly spaced about the circumference of the feed horn. Those junction arms intersect the horn's side at a position along the horn's axis spaced from the right hand open end or entry to the horn's throat. At those ninety degree spaced positions the respective outlet ports each extend through the feed horn's conical side wall and open into the internal conical cavity.

These outlet ports and associated chokes are better illustrated in the partial section view of FIGS. 6 and 7. FIG. 6 is a pictorial partial section view of the horn assembly in FIG. 2, but drawn to a larger scale with the large diameter opening appearing on the left and the throat 3*b* appears to the right. The corrugations are represented by the vertical rectangular undulations 23 in the inner conical surface. Outlet arm 24 appears on the upper side of the figure and the oppositely facing outlet arm 22 on the lower side.

Outlet arm 24 includes a matching section 25 and a microwave choke 33, spaced along the arm or, more aptly, the collar 45. Outlet arm 22 likewise includes matching section 29 and the choke 37. The chokes can be implemented as waveguide bandpass or band rejection filters. The form in which the chokes are implemented by building same into the wall of the corrugated horn's collar 45 to achieve a compact embodiment. If the wall is too thin, the chokes and the matching sections are instead built outside of the horn, such as illustrated in FIG. 6. The remaining junction outlets are not visible in the figure, but are of a like configuration. Reference is made to FIG. 7, which illustrates a portion of FIG. 6 in section view taken along the section lines 7—7 in FIG. 6.

As shown and as one example, a circumferentially extending annular groove may be formed in the ring shaped connecting member 45, shown in FIG. 2, possessing requisite microwave characteristics for use as part of a band rejection filter in each arm and four arcuately curved shorting slug sl, each of which extends only over a prescribed angle or portion of that circumference, are inserted at four locations in that annular groove. A second circumferentially extending groove, may be formed coaxial with the first, and likewise contains four shorting plugs s2. The latter plugs s2 are angularly aligned with the corresponding plug in the former circumferential groove. These grooves leave defined passages for the junction's output arms 18, 20, 22 and 24.

The two operating frequencies, F1 and F2, should be separated by at least 10%; that is, F2>110% F1. In general, the high frequency F2 must use the straight port and the low frequency F1 must use the side arms through the turnstile junction. Usually, F1 is the tranmit frequency and F2 is the receive frequency. However, the same design can be used in applications that require F1 to be the receive frequency and F2 to be the transmit frequency.

The feed horn's throat diameter as viewed in FIG. 6 defines a circular waveguide transmission line that has a cutoff wavelength below the wavelenth of the microwave signal output from the turnstile junction's four ports. Refering again to FIG. 2, the throat 3*b* and the like diameter circular waveguide serially connected to the throat cannot propagate signals at the lower transmit frequency, 20 GHz in the Odyssey example, through throat 3*b* and polarizer 6, but is able to propagate the shorter wavelength, higher frequency 30 GHz signals of the receive frequency. It cuts off the TE11 mode at F1, but not TE11 mode at F2. This characteristic serves to further prevent transmit frequency energy from propagating to the receive frequency circuits in the receiver, where it could cause damage or mask the lower power receive signals. The transmission line formed by the throat thus discriminates against microwaves of one frequency, but not the other.

The corrugated horn provides equal E- and H-plane radiation patterns for circularly polarized wave of high polarization purity. The aperture size is chosen so that the edge taper, the ratio of the field strength intensity hitting the edge of the reflector relative to that hitting at the center of the reflector, is between −8 and −12 dB to maximize the gain efficiency. The corrugated horn employs a wide flare angle to enable (1) relatively constant beamwidth over wide bandwidth; and (2) achieves a relatively stable location of the phase center over a wide bandwidth. The constant beamwidth and the stable phase center location allows the feedhorn assembly to operate at both 20 and 30 GHz.

Chokes 33, 35, 37 and 39, built into the horn wall in front of the horn throat, are designed to reject the 30 GHz receive signals with at least 25 dB rejection. The magic-T's and the 90 degree-Hybrid are connected as shown in FIG. 2 to generate both right-hand circularly polarized wave and left-hand Circularly polarized wave. Therefore, this horn feed assembly design is capable of dual circularly polarized operation. For single Circularly polarized wave operation as in the Odyssey system, the unused port is terminated as at 14. The four matching sections 25, 27, 29 and 31 are used to impedance match the chokes to the connecting waveguides.

The foregoing embodiment is for the Odessey type communication system, which requires only single circular polarized waves. For dual circular mode application at F2, an orthomode junction (OMT) is located between the polarizer 6 and the circular-to-rectangular waveguide transition 2. The side port of the OMT provides one sense, left or right hand, of CP and the through-port of the OMT provides the other sense of CP. For dual circular polarization application at frequency F1, termination 14 is not used, leaving the port unterminated. That port serves for the left hand circular polarized wave.

In operation, with simultaneous transmit and receive, the 20 GHz transmit signals are supplied from the transmitter to the waveguide flange 41 at the right hand side in FIG. 2, propagate through turnstile junction 4 and are injected through the junction's outlet ports 18, 20, 22, and 24 into feed horn 3. More specifically, the ninety degree hybrid 12 splits the incoming signal at 41 into two signals of equal amplitude with ninety degree phase differential and the magic-T's, 8 and 10, further splits the signals after 12 into two signals of equal amplitude with a one hundred and eighty degree phase differential. This enables injection of circularly polarized signals into the feed horn.

The feed horn propagates that energy out its large diameter open end. Those 20 GHz signals are effectively blocked from propagating out the throat to the right in the reverse direction due to the 20 Ghz wavelength being above the cut-off wavelength of the throat. Received 30 GHz signals incident on the feed horn propagate through the throat and are converted to linear polarized waves by polarizer 6, propagate through a circular to rectangular waveguide transition 2 and exits from the rectangular flange 30 at the right hand side, where that microwave energy propagates ultimately to a 30 GHz receiver, not illustrated. The chokes prevent that signal from being diverted into turnstile junction 4, as earlier described.

The horn throat diameter is designed to cut off 20 GHz transmit signals and let the 30 GHZ receive signals pass through into the polarizer. However, the horn diameter at the choke location is chosen large enough to support the principal $TE_{11}$, circular waveguide mode at the 20 GHz transmit frequency.

The 30 GHz Circularly polarized wave is generated by the polarizer. Many commercial waveguide polarizers can be used. In alternative embodiments, an optional orthomode junction (OMJ) may be attached after the polarizer 6 and enables dual circularly polarized wave at 30 GHz. For the proposed odyssey application, dual circular polarized wave operation is not necessary.

It is found that the foregoing dual-band feed assembly is more broad band in nature and hence is less sensitive in tuning than the prior systems. If manufactured dimensions are off slightly due to loose tolerance the center operating frequency is shifted from the desired frequency. However the operating frequency will remain within the working bandwidth of the off-center frequency. For the same reason the assembly is relatively insensitive to temperature change.

As an example of the weight saving attained with one practical embodiment of the gimbaled reflector design as compared to a gimbled box of the conventional design the following data is illustrative.

| Component | Prior | Invention |
|---|---|---|
| Feed Assembly | 1.26 | 1.61 |
| Reflector | 0.60 | 0.76 |
| Gimbal/Caging | 11.39 | 3.30 |
| Gimbal Drive Electronics | 2.60 | 2.60 |
| RF Cables | 1.07 | 0.53 |
| Antenna Unit Weight | 16.92 | 8.80 |
| Total Antenna Weights (3 Units per Spacecraft) | 50.76 | 26.40 |
| Electronics | 44.70 | 44.70 |
| Electronics Box and Mounting | 15.00 | 10.41 |
| Total Feeder Link Subsystem | 110.46 | 81.51 |

The foregoing weights are expressed in kilograms. As gleaned from the foregoing, the weight of the feed assembly and reflector is heavier than the corresponding elements of the prior design, but the overall weight decreases significantly.

An additional benefit of the gimbaled reflector approach is an improved long-term reliability to the antenna system. The gimbaled reflector eliminates any RF moving parts, such as RF rotary joint or flexible wave guide and cables, which are needed in the gimbaled box approach. The life, and consequently the performance degradation over life, of high frequency RF parts constantly flexing over a long period of time is always a design concern for a space-based system.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A steerable microwave antenna assembly for a space satellite, comprising:

a microwave reflector having a concavely curved surface defining a focal point and a predetermined focal length;

a platform for mounting to said space satellite;

a container, said container being of a predetermined height, having top and bottom surfaces and being fixed to an upper surface of said platform with said bottom surface of said container abutting said platform, whereby said container's top surface is elevated in position above said upper surface of said platform; and a bracket, said bracket including a first portion positioned overlying said top surface of said container and a second portion extending at an incline from said top surface of said container to a laterally spaced position located on said platform and underlying said top surface of said container, wherein both said bracket and said container are supported upon said platform;

gimbal means coupled to said microwave reflector for positioning the attitude and elevation of said microwave reflector about a first location on said first portion of said bracket;

a feed horn;

said feed horn for receiving at least a portion of microwave energy of a first frequency incident upon and reflected from said concavely curved surface to a microwave receiver and, alternately, for propagating microwave energy of a second frequency from a microwave energy source to said concavely curved surface; and said feed horn being mounted to a second location on said second portion of said bracket to maintain the position of said feed horn stationary in position relative to said first location; wherein said microwave reflector is adjustable in directional orientation by said gimbal means independently of said feed horn;

said feed horn including a first end oriented facing said concavely shaped surface of said microwave reflector; and said first end being located more proximate said concavely shaped surface than said focal point, irrespective of the directional orientation of said concavely shaped surface.

2. The invention as defined in claim 1, wherein said curved surface further defines a circular perimeter of a predetermined diameter and wherein a ratio of said focal length to said predetermined diameter is greater than 0.7.

3. A steerable microwave antenna assembly for mounting on a space satellite, said microwave antenna assembly for transmitting microwave energy of frequency f1 and receiving microwave energy of frequency f2, comprising:

a platform for mounting to said space satellite;

a container, said container being of a predetermined height, having top and bottom surfaces and being fixed to an upper surface of said platform, whereby said container's top surface is elevated in position above said upper surface of said platform; and a bracket, said bracket including a first portion positioned overlying said top surface of said container and a second portion extending from said top surface of said container at an incline to a position located on said platform adjacent to said container underlying said container's top surface, wherein both said bracket and said container are supported upon said platform;

a microwave reflector having a curved surface and a circular periphery of diameter D, said curved surface defining a focal point and having a focal length L, and wherein the ratio of said L to said D is greater than 0.7;

a feed horn;

said feed horn being electromagnetically coupled to said microwave reflector for coupling of microwave energy therebetween;

gimbal means coupled to said microwave reflector for positioning the attitude and elevation of said microwave reflector at any position within a predefined hemisphere;

said gimbal means being mounted at a first location along said bracket overlying said top surface of said container, whereby said microwave reflector is positioned in attitude and elevation about said first location on said bracket; and said feed horn being mounted upon said bracket at a second location thereon spaced from said container and underlying said top surface of said container, whereby said attitude and elevation of said microwave reflector is positionable without changing the position of said feed horn;

said feed horn comprising:

a hollow right cone having a conical wall, a first large diameter circular opening at one end and a second small diameter circular opening at an opposed end with said first and second openings being spaced from one another along a central axis and a short length circular waveguide integrally connected to said second circular opening coaxial with and of the same diameter as said second circular opening defining a feed horn throat;

said conical wall including an inner surface, said inner surface further comprising a corrugated surface containing surface corrugations oriented transverse to said central axis; and said conical wall further including four passages radially extending therethrough, said passages being located at a predetermined axial position and being equally circumferentially spaced about said central axis to provide a microwave energy propagation path into the interior of said hollow right cone;

said predetermined axial position being spaced from both said feed horn's first and second circular openings at a position that permits maximum coupling of microwave energy through said microwave energy propagation path into said feed horn;

first waveguide transmission line means for propagating microwave energy of frequency f2 from said feed horn to an external microwave receiver;

said first waveguide transmission line means including:

an input end connected to said feed horn throat;

circular waveguide means, said circular waveguide means containing a polarizer;

a circular to rectangular waveguide transition coupled to said circular waveguide means in spaced relation to said polarizer; and a rectangular waveguide flange to provide an output end to said first waveguide transmission line means;

said second small diameter circular opening to said feed horn having a frequency cut off characteristic of a predetermined frequency f3, where said frequency f3 is higher than said frequency f1, whereby said microwaves of frequency f1 are inhibited from propagating into said first transmission line means;

a turnstile junction; said turnstile junction including an input for receiving microwave energy of frequency f1 from a microwave transmitter and four outputs outputting said microwave energy of frequency f1 at four spaced positions and in relative electrical phase relationship at said frequency f1 of zero, ninety, one hundred and eighty and two hundred and seventy degrees, to thereby produce in combination of said four outputs circularly polarized microwave energy of frequency f1;

said four turnstile junction outputs being connected to respective ones of said four passages through said conical wall of said hollow right cone, whereby in response to microwave energy of frequency f1 from said microwave transmitter a circularly polarized microwave of frequency f1 is excited in said feed horn for radiation from said feed horn;

each of said turnstile junction outputs including:

RF choke means for passing microwave energy of frequency f1 and inhibiting propagation of microwave energy of frequency f2 from said feed horn into said respective turnstile junction output to prevent any microwave energy of frequency f2 received at said first large diameter circular opening of said feed horn propagating within said hollow right cone to said first transmission line means from being diverted to said turnstile junction.

* * * * *